United States Patent [19]

Mucci

[11] 4,192,569

[45] Mar. 11, 1980

[54] UNDERWATER CONNECTOR

[75] Inventor: Peter E. R. Mucci, Gravesend, England

[73] Assignee: International Standard Electric Corporation, New York, N.Y.

[21] Appl. No.: 967,253

[22] Filed: Dec. 7, 1978

[51] Int. Cl.[2] ..... H01R 13/52

[52] U.S. Cl. ..... 339/96; 174/21 R; 339/117 R

[58] Field of Search ..... 339/96, 117; 174/21 R

[56] References Cited

U.S. PATENT DOCUMENTS

| | | | |
|---|---|---|---|
| 3,324,449 | 6/1967 | McLoad | 339/117 R |
| 3,378,811 | 4/1968 | Cullen et al. | 339/117 R |
| 3,596,231 | 7/1971 | Melton | 339/96 |

*Primary Examiner*—Joseph H. McGlynn
*Attorney, Agent, or Firm*—William T. O'Neil

[57] ABSTRACT

A sealed connector which can be used for making electrical connection underwater. The connector comprises two chambers one behind the other, the inner chamber containing an electrical connection terminal and being closed by a first diaphragm penetrable by a plug contact, the outer chamber being closed by a second diaphragm also penetrable by the plug contact, both chambers being filled with an electrically insulating grease, jelly or similarly viscous liquid.

8 Claims, 2 Drawing Figures

UNDERWATER CONNECTOR

BACKGROUND OF THE INVENTION

This invention relates to a sealed connector, particularly to such a connector for use in making electrical connection underwater.

U.K. Pat. No. 1379525 relates to an underwater connector and utilizes the principal of a resilient diaphragm closing a chamber in the connector filled with a non-electrically-conducting jelly, grease or similarly viscous liquid in which the actual electrical connection and disconnection takes place. A suitable viscous liquid is described in U.K. Pat. No. 1536541.

It is an object of the present invention to improve further the integrity of such a connector, particularly when making connection while immersed in water.

SUMMARY OF THE INVENTION

According to the present invention there is provided a connector comprising an outer casing, first wall members defining a first chamber in the casing, at least one connection terminal within the first chamber, a first valve closing the first chamber, second wall members defining a second chamber behind the first diaphragm a second valve closing the second chamber, each valve having an aperture openable by a plug plugged into the connector terminal and penetrating both valves, both chambers being adapted to be filled with an electrically insulating grease, jelly or similarly viscous liquid.

According to another aspect of the invention there is provided a method of connecting a plug to a connector which comprises a connection terminal housed in a casing closed by first and second valves axially one behind the other in the casing, the casing being filled with non-electrically-conducting viscous liquid, the method comprising the steps of: inserting the plug terminal through the second valve, but not through the first; purging the casing between the first and second valves with the viscous liquid under pressure; and inserting the plug further to penetrate the first valve and engage the connection terminal.

BRIEF DESCRIPTION OF THE DRAWING

In order that the invention can be clearly understood reference will now be made to the accompanying drawing in which.

DETAILED DESCRIPTION OF THE DRAWING

Figure 1:
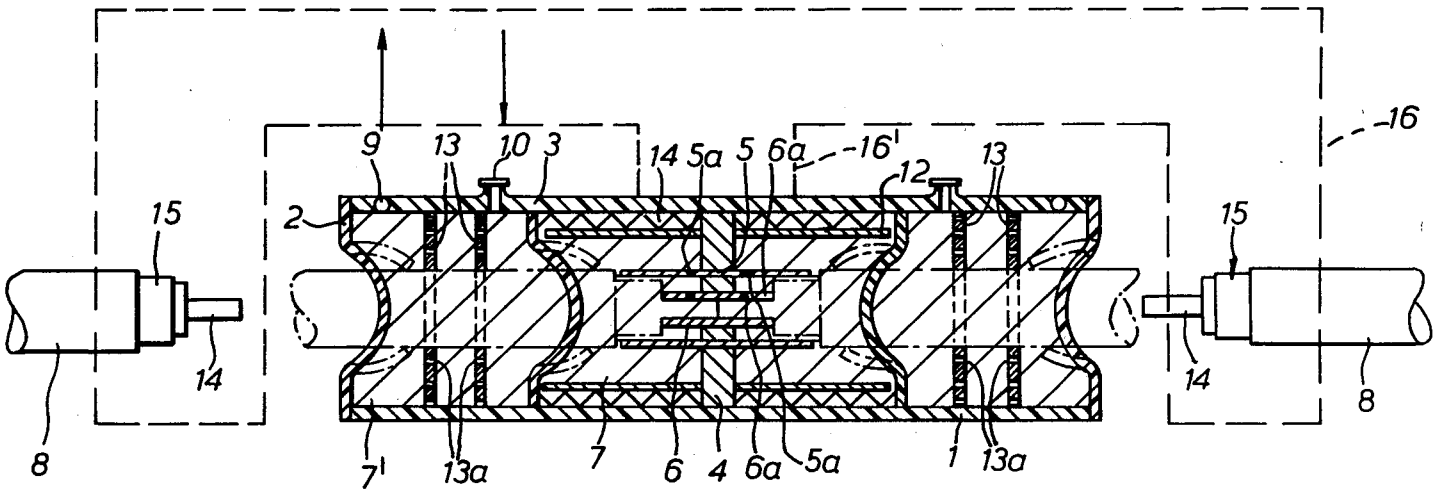
FIG. 1 is a longitudinal cross-section of a coaxial underwater connector according to an embodiment of the present invention and FIG. 2 shows a modification to FIG. 1.
Figure 2:
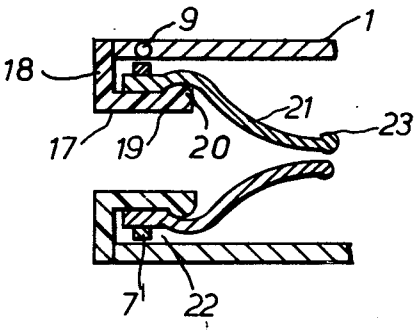

Referring to the drawing this connector is double-ended to connect two ends of a coaxial cable 8. The connector comprises an outer insulated casing 1 of, for example, plastics material containing a fixed insulated bulkhead 4 in the middle. This bulkhead 4 holds an inner connection terminal 6 of tubular form for connecting the inner conductors 14 of the coaxial cable 8. The bulkhead also holds an outer coaxial connection terminal 5 also of tubular form for connecting the outer conductors 15 of the coaxial cable 8.

The connector is substantially symmetrical about its central bulkhead 4 and on each side there are two chambers filled with a non-electrically-conducting grease, jelly or similarly viscous liquid. The inner chamber 7 is closed by an inner valve formed by a flexible diaphragm 3 made of resilient material such as neoprene. This diaphragm is connected to a bellows enabling movement of the diaphragm axially of the connector to accommodate displacement of the viscous liquid in the inner chamber when the coaxial cable is introduced into the connector for connection. A stop tube 12 prevents the diaphragm 3 being pushed further towards the centre of the connector when introducing the coaxial cable.

An outer chamber 7′ is also filled with the non-electrically-conducting viscous liquid and is closed at the outer end of the connector by a second valve in the form of flexible diaphragm 2 of resilient insulating material such as neoprene. The outer chamber 7′ contains two guide rings 13 serving to physically locate the coaxial cable 8 during the connection procedure and subsequently while connected.

Each outer chamber 7′ has a pressure release valve 9 which is a one-way valve serving to release pressure from inside the connector and a purge valve 10 for initially filling the connector with the viscous liquid and subsequently purging.

As can be seen in the drawing, the diaphragms open to embrace the external insulating surface of the cable 8, and in conjunction with viscous liquid, provide a seal against ingress of water or moisture during the connection process and while the cable is connected. The outer diaphragms could be destructible, that is they could be formed of a thin plastics sheet which is destroyed once pierced by the plug.

The preferred way of connecting two ends of a coaxial cable with this connector is as follows. The cable end 8 is introduced through the first diaphragm and displaces some of the insulating liquid through the valve 9. At this point fresh liquid is then introduced through the valve 10 under pressure to force out any water and contaminated fluid which might have been brought into the outer chamber by the introduction of the cable. The cable is then pushed through the diaphragm 3 and the bellows 11 is displaced to take up the volume change. This forces more liquid out of valve 9. The tubular stop 12 prevents premature compression of the diaphragm. The guide rings 13 keep the cable in line with the diaphragm during the operation and are perforated, exemplified by holes 13*a*, to enable free movement of grease therethrough through chamber 7 and out of valve 9. Final clamping of the cable ends with the clamping arrangement such as 16 can then be done to make a permanent fixture and both valves 9 and 10 are preferably shut down. The positions of valves 9 and 10 can be found by experiment. Ideally they are positioned so that the purging thoroughly recovers all water or contamination traces. One valve may be sufficient relying on leakages back through the outer diaphragm for purging.

The connection terminals 5 and 6 are vented at 5*a* and 6*a* to allow grease to move out of the hollow interiors of these terminals during connection of the plug and connector shown schematically by the dotted line. Any arrangement for clamping the structure 16 to the cables can be used and it is preferable although not perhaps essential for the structure to also be secured to the connector, preferably at its midpoint as shown at 16′.

The embodiment described is intended for connecting British Post Office submarine cable type 147 and is dimensioned accordingly. This cable comprises a strong tensile strength member in the centre clad in copper to form an inner conductor 14 which is insulated from the outer rigid screen 15 by extruded plastics insulation and this screen 15 is sheathed in a plastic waterproof and protective layer.

In deep waters such cable has no external armouring but in shallow water an external armouring is necessary to protect against anchors and trawler nets etc. Thus in using this connector to connect in deep water it is necessary to bare the central conductor and screen to a sufficient length to just enable connection according to the dimensions of the connection terminals 5 and 6. For shallow water cable the armouring would need to be removed beforehand and the physical securing arrangement 16 would need to be particularly strong and effective to protect the connector from damage although the risk can be minimized by burying the cable and connector into the sea bed. It is envisaged that an underwater cable could be repaired using this connector in situ without the need to bring the cable ends to the surface. In certain circumstances a diver could perform these operations but in other circumstances it would be necessary to use a submersible craft to carry out the operation. With this arrangement the discs 13 may be superfluous if the spigot 17 provides sufficient guidance for the cable (plug).

In deep waters such cable has no external armouring but in shallow water an external armouring is necessary to protect against anchors and trawler nets etc. Thus in using this connector to connect in deep water it is necessary to bare the central conductor and screen to a sufficient length to just enable connection according to the dimensions of the connection terminals 5 and 6. For shallow water cable the armouring would need to be removed beforehand and the physical securing arrangement 16 would need to be particularly strong and effective to protect the connector from damage although the risk can be minimized by burying the cable and connector into the sea bed. It is envisaged that an underwater cable could be repaired using this connector in situ without the need to bring the cable ends to the surface. In certain circumstances a diver could perform these operations but in other circumstances it would be necessary to use a submersible craft to carry out the operation.

This connector is clearly applicable to connect a plug as well as a cable end and the term plug is used in the claims to include both, it being understood that the cable end functions as a plug.

It is within the scope of the invention for the connector to be single-ended for bulkhead mounting, for the connector to have only one connection terminal, and for the connector to have more than two connection terminals, either coaxial or non-coaxial. If the terminals are non-coaxial then the diaphragms would each need separate respective apertures for the terminals and furthermore the plug and socket would require co-operating parts to ensure that they could only be connected in a predetermined mutual orientation, for example with a ridge and groove such as is disclosed in U.K. Pat. No. 1379525.

I claim:

1. A connector comprising an outer casing, first wall members defining a first chamber in the casing, at least one connection terminal within the first chamber, a first diaphragm closing the first chamber, second wall members defining a second chamber behind the first diaphragm a second diaphragm closing the second chamber, each diaphragm having an aperture openable by a plug plugged into the connector terminal and penetrating both diaphragms, both chambers being adapted to be filled with an electrically insulating grease, jelly or similarly viscous liquid.

2. A connector comprising a casing, having a hollow interior, an insulating support member within the casing, a connection terminal supported by and projecting from both sides of the support member, and, on each side of the support member, first and second flexible diaphragms, each diaphragm defining an aperture penetrable by a plug inserted into the connector from either side, the casing being adapted to be filled with a non-electrically-conducting grease, jelly or similarly viscous liquid.

3. A connector according to claim 1, wherein the casing has a fluid access port for purging the casing with a non-electrically-conducting grease, jelly or similarly viscous liquid between the first and second diaphragms.

4. A connector according to claim 3 comprising a second fluid access port in the casing.

5. A connector according to claim 3 wherein said port is valved.

6. A connector according to claim 5 wherein the valved port has means to close it down.

7. A method of connecting a plug to a connector which comprises a connection terminal housed in a casing closed by first and second diaphragms axially one behind the other in the casing, the casing being filled with non-electrically-conducting viscous liquid, the method comprising the steps of: inserting the plug terminal through the second diaphragm, but not through the first; purging the casing between the first and second diaphragms with the viscous liquid under pressure; and inserting the plug further to penetrate the first diaphragm and engage the connection terminal.

8. A method as claimed in claim 7, wherein said steps are carried out underwater.

* * * * *